US006015343A

United States Patent [19]

Castillo et al.

[11] Patent Number: 6,015,343

[45] Date of Patent: Jan. 18, 2000

[54] TILE ROOF VENT

[75] Inventors: Richard Castillo, San Jose, Calif.; Ravinder Nair, Warren, N.J.; Krishna Srinivasan, Mahwah, N.J.; Edward C. Villela, Leonia, N.J.

[73] Assignee: Building Materials Corporation of America, Wayne, N.J.

[21] Appl. No.: 09/204,438

[22] Filed: Dec. 2, 1998

[51] Int. Cl.[7] ..... F24F 7/02

[52] U.S. Cl. ..... 454/365; 52/199

[58] Field of Search ..... 52/198, 199; 454/365

[56] References Cited

U.S. PATENT DOCUMENTS

| | | | |
|---|---|---|---|
| 2,200,031 | 5/1940 | Lee | 454/365 |
| 4,280,399 | 7/1981 | Cunning . | |
| 4,325,290 | 4/1982 | Wolfert . | |
| 4,676,147 | 6/1987 | Mankowski . | |
| 4,817,506 | 4/1989 | Cashman . | |
| 4,903,445 | 2/1990 | Mankowski | 52/199 |
| 5,092,225 | 3/1992 | Sells | 454/365 |
| 5,095,810 | 3/1992 | Robinson | 454/365 |
| 5,122,095 | 6/1992 | Wolfert | 454/365 |
| 5,326,318 | 7/1994 | Rotter . | |
| 5,457,920 | 10/1995 | Waltz | 52/199 |
| 5,458,538 | 10/1995 | MacLeod et al. | 454/365 |
| 5,561,953 | 10/1996 | Rotter | 454/365 X |
| 5,651,734 | 7/1997 | Morris | 454/365 |

FOREIGN PATENT DOCUMENTS

| | | | |
|---|---|---|---|
| 36 15 015 | 12/1987 | Germany | 454/365 |
| 632006 | 11/1949 | United Kingdom | 454/365 |
| 810250 | 3/1959 | United Kingdom | 454/365 |
| WO 93/04323 | 3/1993 | WIPO . | |

*Primary Examiner*—Harold Joyce
*Attorney, Agent, or Firm*—Imre Balogh; William J. Davis; Marilyn J. Maue

[57] ABSTRACT

Tile roof vent for covering the opening of the ridge of an undulating tile roof. The vent includes two panels spaced from each other, each of which has a hard plastic sheet with a lower portion and an upper portion. To the underside of the lower portions are affixed an air-permeable mat and optionally a layer of foam rubber which conform to the undulating configuration of the tile roof. The lower portions of the hard plastic sheets are reinforced by stiffeners integral with the hard plastic sheet and also contain vent holes for exhausting air from the attic space.

44 Claims, 7 Drawing Sheets

TILE ROOF VENT

BACKGROUND OF THE INVENTION

1. Field of the Invention

This invention relates to tile roof vents having undulating configurations. More particularly, the invention relates to roof ridge vents used on roofs having ceramic or metal tile coverings.

2. Reported Developments

Ventilators for attics of buildings are perforated or baffled vent openings in the underside of the eaves of an overhanging roof or facia and on the roof ridge overlaying the open roof along the length of the roof. The vent openings allow outside air to flow into the attic to equalize the interior attic temperature and pressure with that of the outside environment. This equalization helps to prevent degradation of the roof structure, reduces the accumulation of condensation in the insulating material covering the floor of the attic thereby increasing the efficacy of heating/cooling of the living space in the building covered by the roof structure.

The ventilator system of the prior art is typically comprising: a roof ridge ventilator and a soffit ventilator. The roof ridge ventilator overlays the open roof along the length of the roof for exhausting the air from the space below the roof and the ceiling of the attic, i.e., as the air entering the attic through the soffit vent mixes with the warmer air in the attic, it has to be expelled through an opening in the roof ridge where the lighter, warmer air accumulates. Desirably, the volume of air intake through the soffit ventilator should be balanced by the volume of air exhaust through the roof ridge ventilator. In an optimum soffit ventilator/roof ridge ventilator system there is a balance between the net free open area presented by such system. The terminology "Net Free Open Area" or NFA means the cross-sectional area of a ventilator system which is open for passage of air therethrough. This balance of the net free open area of a soffit ventilator and roof ridge ventilator is difficult to achieve. Thus in many existing and newly built buildings there tend to be an out of balance soffit/roof ridge ventilation system.

Ventilation systems should also provide against insects entering into the attic space of buildings. While large perforations in the soffit and roof ridge ventilation panels would render the desired flow of air through the attic space, they would also allow ingress to insects therein to form insect colonies.

In addition to having good ventilation of the attic space and preventing ingress of water, snow and insects into the attic space, the desiderata in a ventilation system includes: structural strength and stability to withstand the affects of the elements, such as high wind; strong structural support against collapse or warping, such as occurs by the accumulation of snow or ice or by the weight of the installers accidentally stepping on the roof ridge ventilator; easy handleability on installation; and low costs. In roof ridge ventilators designed for use on heavy roofing tiles made of slate, terra cotta, concrete, clay and metals, the roof ridge ventilator has to support the heavy ridge tiles in addition to snow and ice accumulating on the roof.

The present invention is directed to roof ridge vents which preferably are used in conjunction with an adequate soffit ventilator of the prior art.

Illustrative examples of the prior art directed to roof ridge ventilators are as follows.

U.S. Pat. No. 5,326,318 discloses a roof ridge ventilator for use with heavy roofing tiles. The ventilator comprises an elongated metal support member shaped as a hollow rectangular-section beam with the bottom of the beam open and skirt sections flared therefrom at the slope angle of the roof. The shape of the support member includes:

a) a cap element anchoring and support portion running along the top of the hollow beam;

b) two longitudinally oriented side walls containing vent openings therein, each wall connected to and depending vertically downward from the support portion; and c) two longitudinally-oriented skirt portions conforming to the slope of the roof.

The cap clement and side walls define a longitudinally oriented channel which contains an air-permeable material. The ventilating air passes through the air-permeable material and out of the vent openings.

WO 93/04323 discloses a roof vent of synthetic fiber matting constructed of randomly oriented synthetic fibers. In one embodiment for use with heavier slate or terra cotta tiles, the mat includes a grid pattern of small solid cores extending through the thickness of the mat. The mat is cut to length from a roll and installed over the ridge slot, with capping shingles or tiles nailed on top of it.

U.S. Pat. No. 5,651,734 discloses a ridge cap roof ventilator applied in roll form comprising a corrugated plastic sheet material.

U.S. Pat. No. 4,676,147 relates to a roof ridge ventilator comprising: a one piece cover member including a pair of flaps and a hinge unitary with the flaps to allow for installing the ventilator on roof ridges of different angles. Vents are located under the flaps. The vents also have an interior baffle structure to deflect air flow and to limit entry of foreign particles through the roof ridge.

U.S. Pat. No. 4,280,399 discloses a roof ventilator comprising a corrugated plastic sheet material which may be mounted transversely across any roof ridge regardless of its contours or roof angles.

U.S. Pat. No. 5,457,920 discloses a ridge top vent for roofs which vent includes grill portions flexibly located longitudinally along the lateral edges. The grill portions have at their distal end a set of flexible teeth adapted to fit on shingles and down between shingles in the gaps therebetween, so as to prevent passages between the grills and the shingles of any debris, insects or vermin.

U.S. Pat. No. 4,817,506 discloses a roof vent which includes a sheet-like cover having an inverted V-shaped cross-section. A pair of baffles are disposed on the lower surface of the cover and include a plurality of spaced partitions for supporting the baffles rigidly against the cover.

U.S. Pat. No. 5,095,810 discloses a roof ridge ventilation system comprising:

a ridge vent composed of two panel portions joined together and forming an inverted V-shaped configuration which fits over the peak of the roof. A plurality of V-shaped baffles support the panels. Ventilation ribs are included extending downwardly from each side of the panels to allow passage of air into and out of the openings in the roof. An angled flange is also provided on both sides of the ridge vent to deflect air upwardly and over the roof to create negative air pressure which in turn helps to exhaust stagnant air from the attic space.

U.S. Pat. No. 5,458,538 discloses a roof vent comprising a one-piece plastic body. A plurality of transverse supports are provided for the one-piece plastic body. The system includes a wall to deflect entry of snow and rain. There are also drain openings to allow moisture to escape.

Although the prior art has provided various ventilation systems to address the desiderata, we have found that the balance of the Net Free Open Area for a soffit ventilator and roof ridge ventilator has not been quite adequately achieved for the reason that the roof ridge ventilators do not allow the passage of sufficient amounts of attic air to pass therethrough while preventing entry of snow, rain, ice and insects. Roof ridge ventilators designed for use with tile roof and having air-permeable vent material as water and insect barriers tend to be compressed by the heavy roof tiles thereby providing limited air circulation. Support structures to prevent compression or crushing of the air-permeable material are costly and difficult to install.

The present invention is directed to solve these problems in a tile roof vent, which is preferably used in conjunction with a soffit ventilator system of the prior art.

SUMMARY OF THE INVENTION

The present invention is directed to a tile roof vent for use in ventilating a building having a sloped roof which has an opening running longitudinally in its ridge portion. The angle determining the slope may vary from 20° of a relatively "flat roof" to 45–60° of a steep roof. Such variation in the angle of slopes is influenced by the building style, the size of the roof and weather conditions. A tile roof comprises sinusoidal, such as semi-circular or S-shaped tiles laid in rows running across the slope of the roof from the bottom edge of the roof toward the ridge of the roof. The rows are laid in alternating inverted and overlapped position to each other to form an undulating sequence of crests and valleys running from the bottom edge of the roof toward the ridge of the roof. The valleys serve as gutters to lead precipitation down from the ridge toward the bottom edge of the roof. The top row of tiles are omitted on each side of the ridge in order to create a gap or opening in the ridge to provide for ventilation of the air from the attic space. This gap or opening is to be covered by a tile roof vent to prevent entry of moisture and insects.

The present tile roof vent is placed onto the top row of tiles on each side of the ridge to cover the gap or opening in the ridge. The profile of the tile roof vent assumes the same undulating configuration as the top row of tiles on each side of the ridge. Because of conformance to the tile row configuration, the tile roof vent of the present invention has a low profile and is hardly visible from a distance. The tile roof vent comprises:

a) two hard plastic sheets or panels each having a top surface and a bottom surface, comprising a flat portion and an angled portion;

b) a fibrous air-permeable mat affixed to the bottom surface of the flat portion of each of the hard plastic sheets; and optionally c) a layer of foam rubber affixed to each of the fibrous air-permeable mat.

The two hard plastic sheets or panels arc mirror images of each other when placed over the gap or opening of the roof ridge. Reference made herein to one is relevant to the other as well.

The interstices of the fibrous air-permeable mat are small enough to prevent entry of insects through the mat. The fibrous mat and foam rubber layer may be attached to the hard plastic sheet at the time of manufacturing the tile roof vent or they may be placed on the tiles at the job site followed by placing the hard plastic sheet thereon. In either case attachment is preferably by the use of a thermoplastic material or glue known in the building industry.

The hard plastic sheet has an angled configuration with an obtuse angle. The flat portion, having the air-permeable mat and foam rubber layer on the bottom surface or underside, is designed to be placed on the top row of the undulating tiles on each side of the ridge, while the angled portion points upward at an angle larger than 90° but less than 180°, and preferably at about 110° to 140°.

The angled portions of the tile roof vent when installed serve as a chimney helping to circulate the air from the attic space to the outside.

The hard plastic sheet or panel is provided with a plurality of vent holes on the profile portion thereof, the holes running in parallel rows to the edge lip of the panel. The flat portion of the panel is also provided with stiffeners which are dome-shaped and pointing upward from the top surface of the panel and run in parallel rows to the ridge of the roof. The stiffeners serve as reinforcements in the panel in supporting the ridge tiles placed over the tile roof vent.

The method of installing the tile roof vent of the present invention comprises the steps of:

a) installing sinusoidal such as semi-circular or S-shaped tiles in rows running across the slope of the roof from the bottom edge of the roof toward the ridge of the roof, omitting the top row of tiles on each side of the ridge, wherein said rows of sinusoidal such as semi-circular or S-shaped tiles are being laid in alternating inverted and overlapping position to each other to form an undulating sequence of crests and valleys running from the bottom edge of the roof toward the ridge of the roof, said valleys serving as gutters to lead precipitation down from the ridge toward the bottom edge of the roof;

b) positioning two unitary panels over the opening in the ridge so that the lower portions of the panels rest on the uppermost top rows of the undulating roof tiles and their crests and valleys conform to that of the roof tiles, and spacing the two panels from each other;

c) affixing the lower portions of the panels to the roof by an adhesive means or fasteners;

d) positioning ridge tiles over the tile roof so that:

1) the ridge tiles are aligned longitudinally over the tile roof vent;

2) the ridge tiles are supported by the ridge board, and the leading edge of ridge tile rests on the leading edge of the tile roof vent; and 3) the ridge tiles are spaced from said angled portions of the hard plastic sheets so as to form a gap therebewteen and thereby allowing circulation of air in the space enclosed by the tile roof vent and the ridge tiles; and e) affixing the ridge tiles to the tile roof vent and the underlying sloped roof by using adhesives or fasteners.

BRIEF DESCRIPTION OF THE DRAWINGS

In the drawings, like numerals indicate like elements and primes (') indicate counterparts of such like elements.

DETAILED DESCRIPTION OF THE INVENTION

Figure 1:
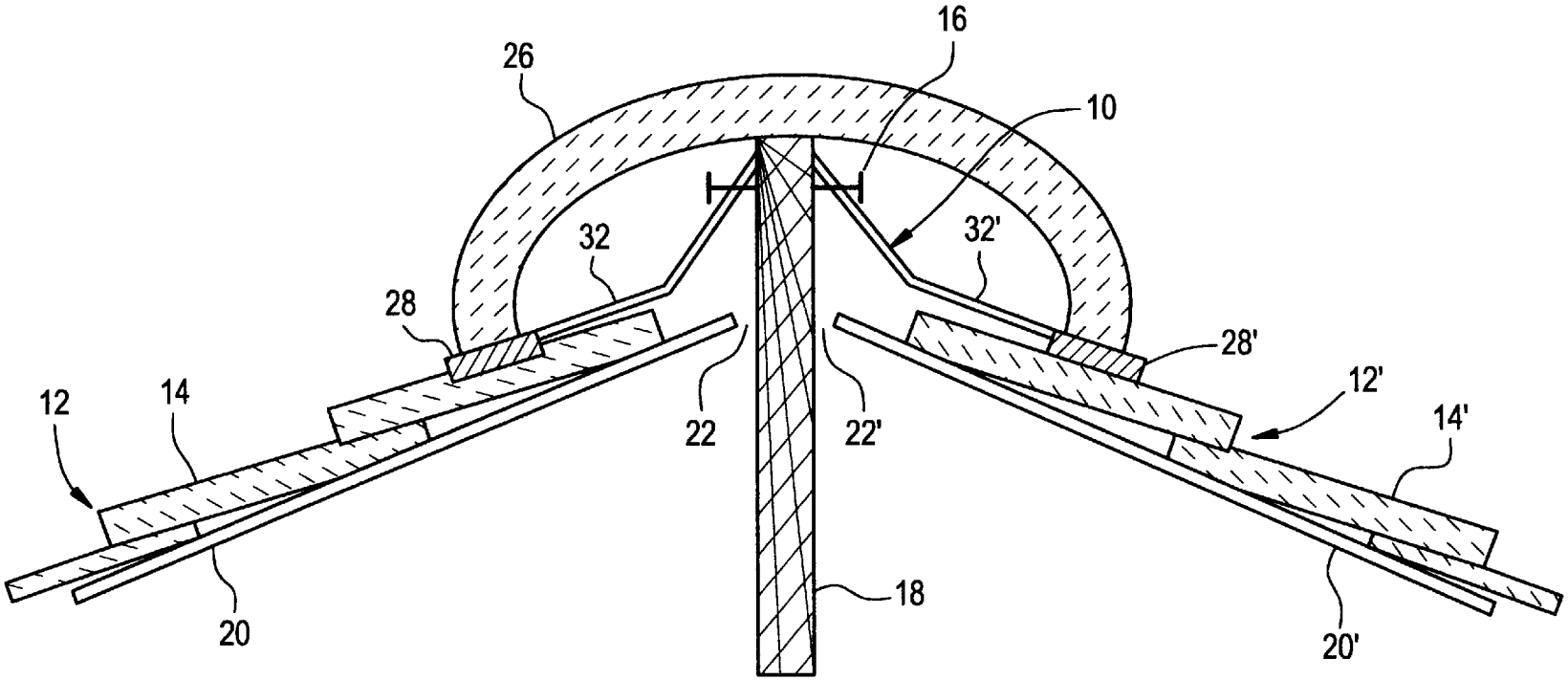
FIG. 1 is a cross-sectional view of a portion of roof ridge showing an embodiment of the tile roof vent of the present invention positioned over the roof ridge having an opening therein.

FIG. 1 is a cross-sectional view of a portion of a roof ridge showing an embodiment of the tile roof vent of the present invention designated generally as 10. The tile roof vent is described in relation to sloped roof 12 and 12', covered with metal or ceramic tiles such as terra cotta tiles 14 and 14' of generally semi-circular or S-shape and overlapping each other. The overlapping tiles form ridges and valleys which are parallel to the slope of the roof directing the flow of precipitation from the roof ridge downward to a gutter. The ridges and valleys form an undulating sequence characteristic of tile roofs. Sloped roof 12 and 12' comprise: a ridge board 18 to which the rafters are attached by nails (not shown) or other suitable means; plywood decking or sheathing 20 and 20'; and roof tiles 14 and 14' laid over the sheathing in an overlapping relationship to one another. The plywood decking and covering roof tiles on the plywood decking do not completely cover roof 12 and 12'; at the ridge of the roof there are gaps or vent slots designated by the numerals 22 and 22' which serve as exits for air in the attic space 24. The gaps exist between each pair of rafters defining a continuous space under the peak of the roof so that the attic air can be vented to the outside. While the gaps would provide for maximum ventilation of the attic space, it would allow entry of rain, snow, insects and debris to enter into the attic space. To prevent such entry, as well-known in the art, a ridge vent covers the gaps and at least partially overlaps the plywood deck and tiles of the roof. The overlap ensures that precipitation does not migrate toward the peak of the roof and enter the attic space. The ridge of the roof over the ridge vent is covered by ridge or cap tiles 26.

The present inventive tile roof vent 10 covers the gap at the peak of the roof and provides for proper ventilation of attic space 24 while preventing entry of moisture, birds and insects thereinto without substantially affecting the maximum ventilating capability of the gaps if left uncovered. The tile roof vent 10 is secured to the ridge board 18 by roofing nails 16 or other securing means. This, and other aspects of the tile roof vent will be explained as the description thereof follows.

The present invention will be described in connection with undulating rows of ceramic tiles, such as terra cotta tiles, as the preferred roof covering material. However, the invention can be practiced in conjunction with other undulating rows of tiles, panels or shingles made of synthetic material, wood, and metal such as steel, aluminum and copper. These metal roofs are typically coated with earthtone granules and with a final paint coat of polymer materials. The granules and/or the final paint coat may be of various colors. Copper is most revered and expensive roofing material having many advantages over other roofing materials. It weathers to a beautiful green patina which protects the surface from further oxidation. It is light weight; cools faster on summer evenings, whereas regular asphalt shingles hold the heat much longer. Copper and aluminum roofing is made from recycled materials and therefore are environmentally desirable. We prefer the use of terra cotta tiles for reason of its roof insulating properties and its relatively low cost.

Figure 2:
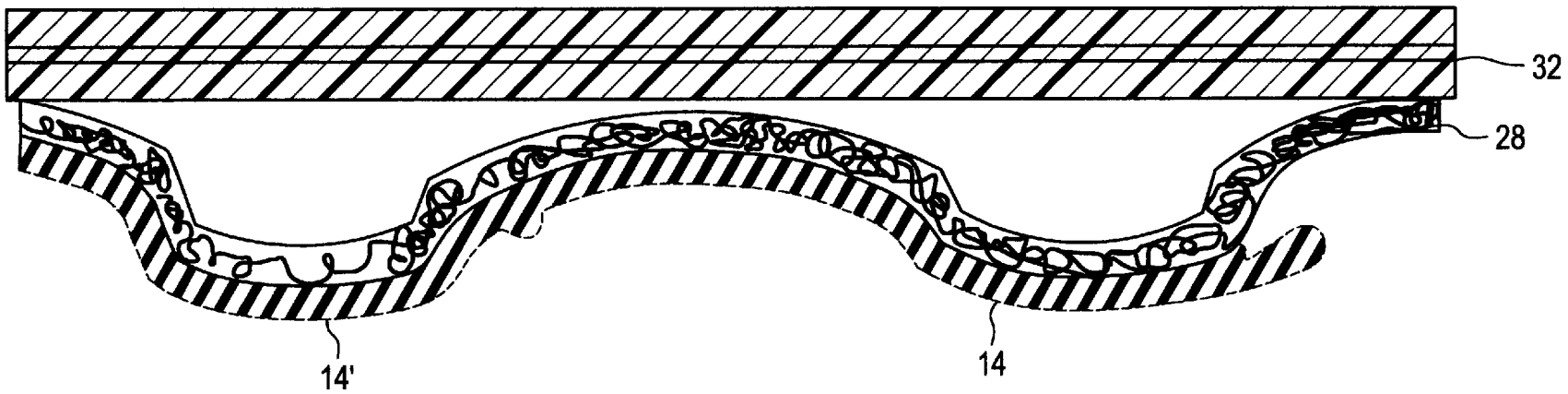
FIG. 2 shows the profile of the tile roof vent in fragmentary side-elevational view laid over roof tiles.

FIG. 2 depicts the profile of tile roof vent 10 in fragmentary side-elevational view laid over roof tiles 14 and 14' of the sloping roof. The roof tiles as shown, are in a partial overlapping configuration with each other. The tile roof vent laid over the roof tiles at their leading edge facing the ridge board comprises: a mat of fibrous material 28 which is integral with a hard plastic panel 32; and optionally, a thin foam rubber sheet 30 on the underside of the mat of fibrous material as shown in side elevational view in FIG. 3.

The fibrous material forming the mat 28 is of randomly oriented synthetic, air-permeable fibers with varying mesh sizes. The synthetic fibers, such as made from nylon and polyester are randomly aligned into a web. The web is oven-cured to bind the fabrics into a mat having intestices therein to allow air flow therethrough. Polymeric materials for bonding the synthetic fibers together include polyester elastomers, ethylene methacrylate, ethylene vinyl acetate, ethylene vinyl alcohol, polyethylene and polypropylene. The average diameter of the intestices between randomly oriented fibers can be of from about 0.2 mm to about 5 mm and preferably about 1 mm. The thickness of the mat typically is of from about 0.5 to 3 inches. The air-permeable mat is cut into strips the length and width of which is determined by the length and width of the tile roof vent in which the strip will be used. Preferred polymeric material for bonding the synthetic fibers is polyvinyl chloride. U.S. Pat. No. 5,167,579 discloses air-permeable resilient material being used in ridge vent which is incorporated herein by reference.

The hard plastic panel 32 and 32' are made of well known polymeric materials including polyvinyl chloride, polyethylene and polypropylene.

The foam rubber sheet 30 may be of open or closed cell foam of elastomeric materials.

Elastomeric materials for constructing the sheet include:

natural rubber;

acrylate-butadiene rubber;

cis-polybutadiene;

chlorobutyl rubber;

chlorinated polyethylene elastomers;

polyalkylene oxide polymers;

ethylene vinyl acetate;

fluorosilicone rubbers;

hexafluoropropylene-vinylidene fluoride-tetrafluoroethylene terpolymers, such as sold under the tradenames of Fluorel and Viton;

butyl rubbers;

polyisobutene, such as sold under the tradename Vistanex;

synthetic polyisoprene rubber;

silicone rubbers;

styrene-butadiene rubbers;

tetrafluoroethylene propylene copolymers; and thermoplastic-copolyesters.

Figure 3:
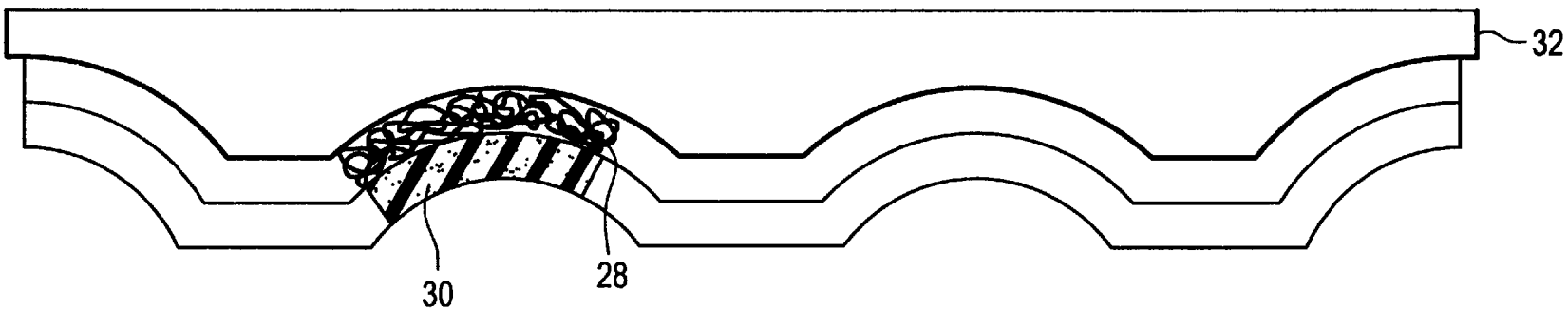
FIG. 3 is a side-elevational view of the fibrous mat, foam rubber and hard plastic panel of the tile roof vent.

FIG. 3 is a side-elevational view of fibrous mat 28, foam rubber 30, and hard plastic panel 32. Examplary thickness of the fibrous mat is of about 0.25" to 2.0", preferably of about 0.75; and exemplary thickness of the foam rubber is of about 0.25" to 1.5", preferably of about 0.5". Typical thickness of the hard plastic panel, fibrous mat and foam rubber taken together is about 3" to 6" while the length of the panel is about 37". The panels on installation are put together end-to-end. At each end of a panel the fibrous mat and foam rubber arc cut back about 0.25" to 0.50" so that there exists an overlap clearance for matching two panels together end-to-end.

Figure 4:
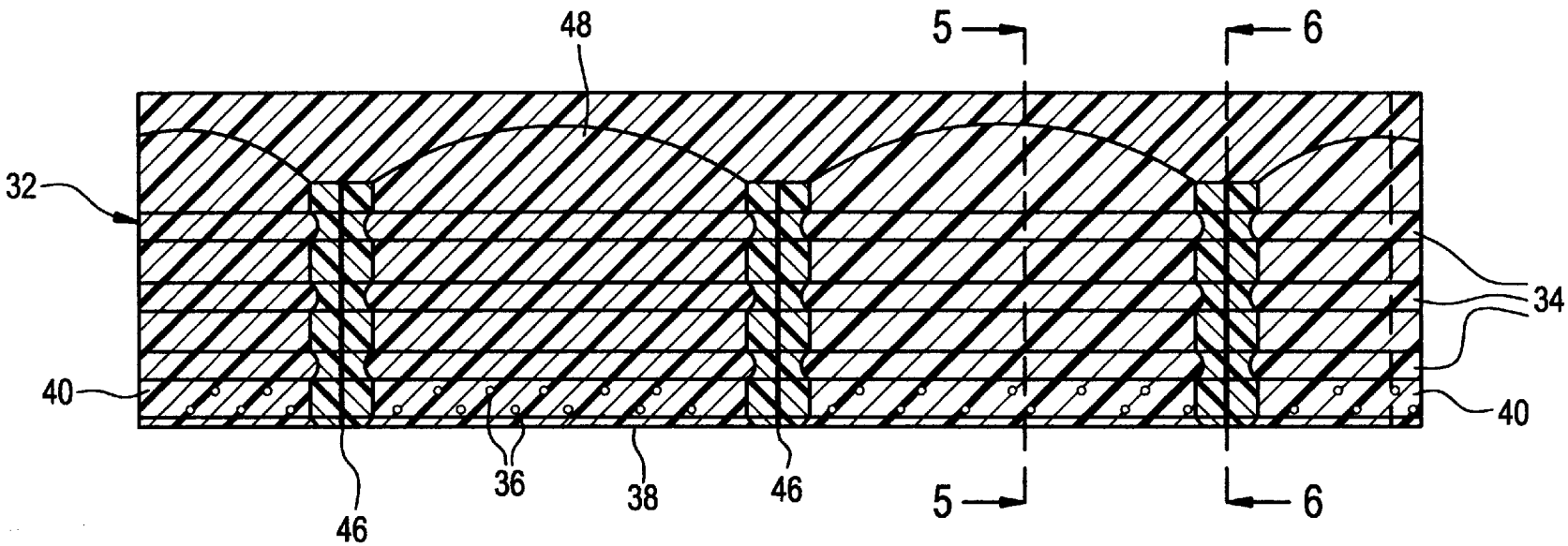
FIG. 4 is a top plan view of one embodiment of the tile roof vent.
Figure 5:
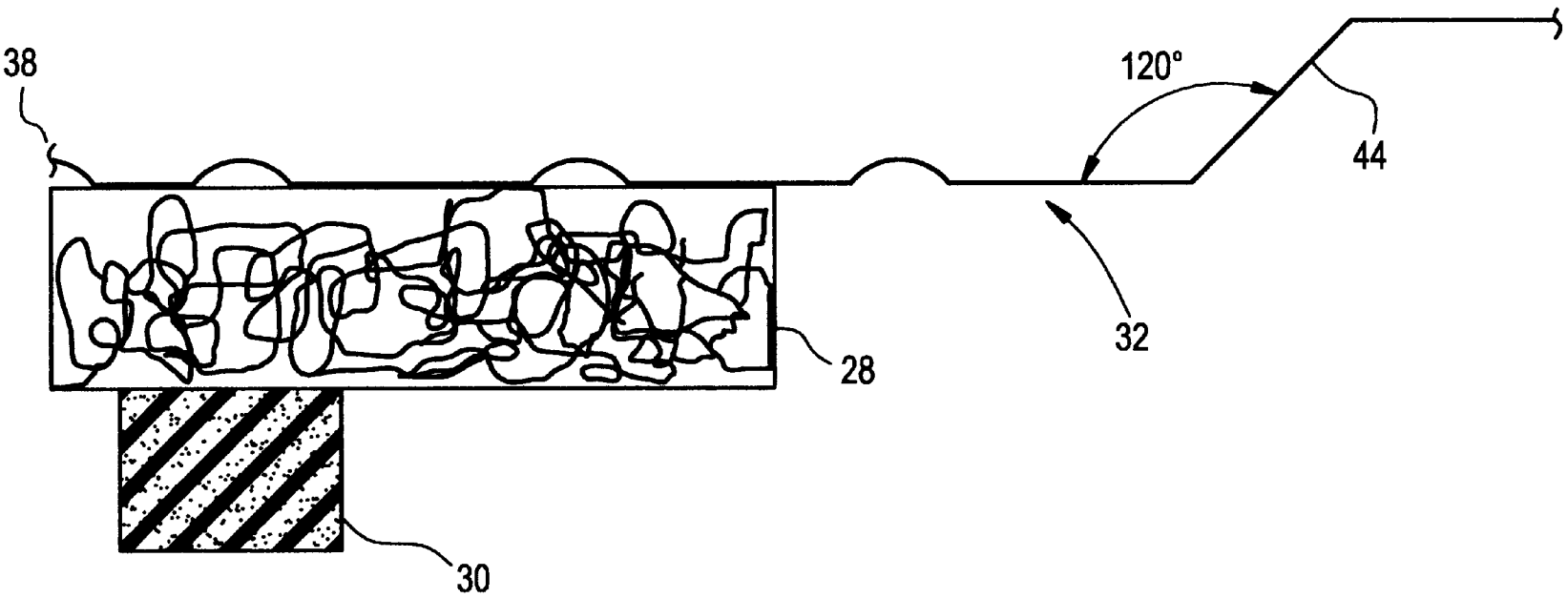
FIG. 5 is a cross-section of the tile roof vent taken along the line 5—5 of FIG. 4.
Figure 6:
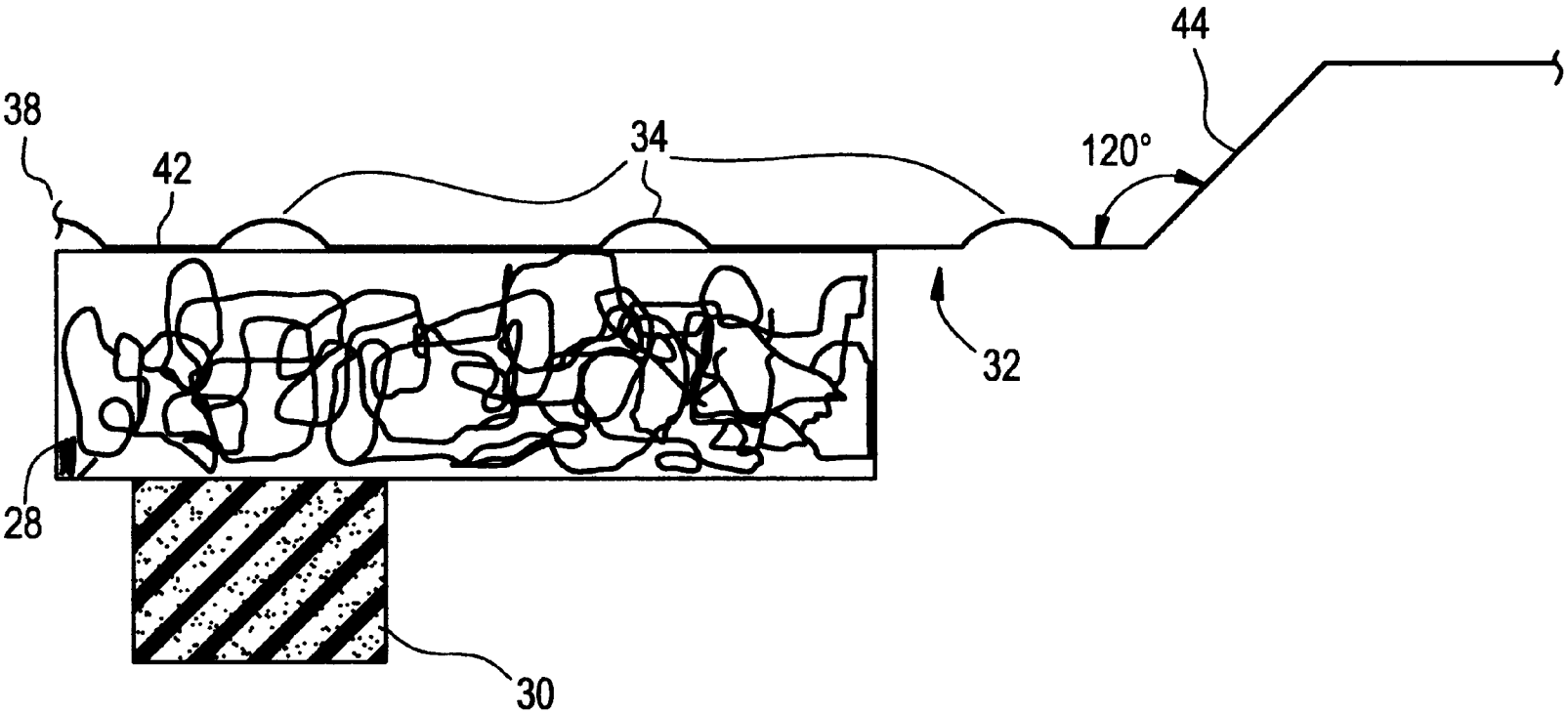
FIG. 6 is a cross-section of the tile roof vent taken along the line 6—6 of FIG. 4.

FIG. 4 shows a top view of one embodiment of the tile roof vent of the present invention wherein the numeral 36 denotes vent holes, the numeral 34 denotes stiffeners, the numeral 38 denotes an edge lip and the numeral 40 denotes overlap clearance where the fibrous mat and foam rubber are cut back. FIGS. 5 and 6 show cross-sections of the tile roof vent taken along the lines 5—5 and 6—6 of FIG. 4 respectively. Panel 32 illustrates a left-hand configuration as it would be placed on the ridge of sloped roof 12. The right-hand configuration of panel 32 preferably is the mirror image of the left-hand configuration as best seen in FIG. 1 and the description which follows is relevant to both panels. Panel 32 comprises a lower portion 42 and an upper portion 44. The angle of the upper portion, as shown in FIGS. 5 and 6, is about 120° as measured from the lower portion. The angle, however, is determined by the slope of the roof. It is preferred that the upper portion be generally perpendicular to a horizontal plane. Stiffeners 34 are preferably of dome-shaped configuration and serve to strengthen the panel against the weight of ridge tiles 26. The stiffeners run parallel to each other and in the longitudinal direction of the panel. While in FIGS. 4–6 three stiffeners are shown, their number may be increased if so desired. Panel 32 further comprises edge lip 38 which serves to direct precipitation away from the underlying fibrous mat.

The tile roof vent 10 of the present invention can be manufactured in unitary sheets and delivered to the installation site. Installation includes placing panels in an overlapping end-to-end relationship to each other and affixing the panels to the ridge board 18 by metal screws or nails. Ridge or cap tiles 26 are then placed over the tile roof vent, as shown in FIG. 1, and secured to the tile roof vent by adhesive or other means. Air from and into attic space 24 will pass through the vent holes 36 as well as through the fibrous mat 28 and 28'. However, the tile roof vent will prevent precipitation and insects from entering into the attic space.

Figure 7:
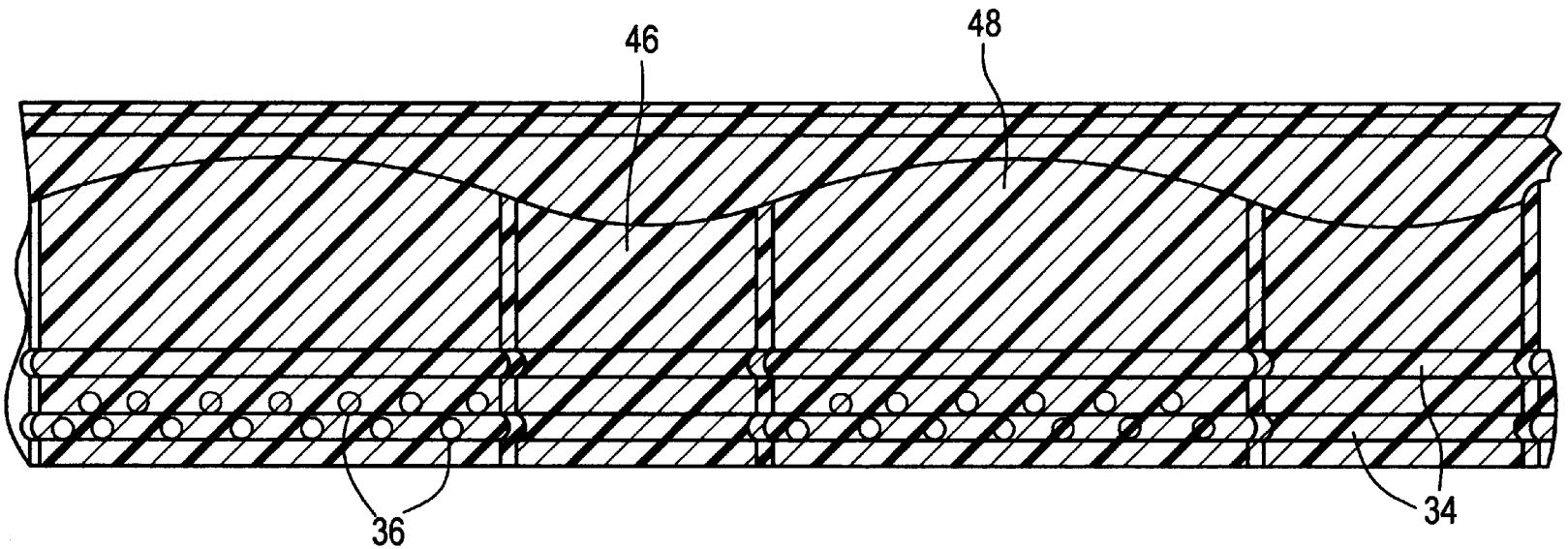
FIG. 7 shows another embodiment of the present invention in fragmentary top plan view.

FIG. 7 illustrates another embodiment of the tile roof vent of the present invention in fragmentary plan view, wherein there are provided two stiffeners 34. While there are shown two rows of vent holes 36 similarly to that shown in the FIG. 4 embodiment, one row of vent holes are positioned in one of the two stiffeners. Gutter covering portions 46 of the panel 32 occupy larger portions with respect to the semi-circular ridge covering portions 48 of the panel. This and similar variations of the respective panel portions allow for matching the underlying roof tiles 14 and 14' as best seen in FIG. 2.

What is claimed is:

1. A tile roof vent for covering the ridge or roof to wall area of an undulating flat through high profile tile roof, said ridge or roof to wall area having an opening therein for allowing ventilation of static air from an attic space of a building, said tile roof vent comprising:

two unitary panels positioned over said opening, said panels being spaced from and projecting a mirror image of each other, wherein each of said panels comprises:

a) a hard plastic sheet having a lower portion; and an upper portion which is integral with said lower portion, said lower portion having a stiffener therein; and b) a sinusoidally shaped air-permeable fibrous mat on the underside of said lower portion of the hard plastic sheet;

wherein ridge tiles covering said tile roof vent are being supported at their leading edge by said lower portions of said hard plastic sheet and a ridge board at the centers thereof.

2. The tile roof vent of claim 1 wherein said lower and upper portions of said hard plastic sheet form an obtuse angle therebetween.

3. The tile roof vent of claim 2 wherein said obtuse angle is larger than 90° but less than 180°.

4. The tile roof vent of claim 3 wherein said angle is of from about 110° to about 140°.

5. The tile roof vent of claim 1 wherein a sinusoidally shaped foam layer is attached to said sinusoidally shaped air-permeable mat on the underside thereof.

6. The tile roof vent of claim 1 wherein said lower portion of said hard plastic sheet contains a plurality of stiffeners therein.

7. The tile roof vent of claim 6 wherein said stiffeners arc dome-shaped.

8. The tile roof vent of claim 1 wherein said hard plastic sheets contains vent holes therein.

9. The tile roof vent of claim 1 wherein said hard plastic sheets contains a plurality of rows of vent holes therein.

10. The tile roof vent of claim 1 wherein said undulating tile roof is of ceramic material.

11. The tile roof vent of claim 1 wherein said undulating tile roof is of terra cotta.

12. The tile roof vent of claim 1 wherein said undulating tile roof is of slate.

13. The tile roof vent of claim 1 wherein said undulating tile roof is of metal.

14. The tile roof vent of claim 1 wherein said undulating tile roof is of steel, aluminum or copper.

15. The tile roof vent of claim 1 wherein said hard plastic sheet is made of a polymeric material selected from the group consisting of:

polyethylene;
polypropylene;
polyvinyl chloride;
nylon,
polystyrene;
polyester;
natural rubber;
acrylate-butadiene rubber;
cis-polybutadiene;
chlorobutyl rubber;
chlorinated polyethylene elastomers;
polyalkylene oxide polymers;
ethylene vinyl acetate;
fluorosilicone rubbers;
hexafluoropropylene-vinylidene fluoridc-tetrafluoroethylene terpolymers;
butyl rubbers;
polyisobutene;
synthetic polyisoprene rubber;
silicone rubbers;
styrene-butadiene rubbers;
tetrafluoroethylene propylene copolymers; and
thermoplastic-copolyesters.

16. The tile roof vent of claim 1 wherein said air-permeable mat comprises synthetic fibers bound together by a polymeric material selected from the group consisting of copolyester elastomers, ethylene methacrylate, ethylene vinyl acetate, ethylene vinyl alcohol, polyethylene and polypropylene.

17. The tile roof vent of claim 1 wherein said foam rubber is selected from the group consisting of natural rubber, acrylate-butadiene rubber, chlorobutyl rubber, fluorosilicone rubber, butyl rubber, polyisoprene rubber and silicone rubber.

18. The tile roof vent of claim 1 wherein said air-permeable mat has a thickness of about 0.5 to 3 inches.

19. The tile roof vent of claim 5 wherein said foam rubber has a thickness of about 0.25 to 1.5 inches.

20. The tile roof vent of claim 5 wherein said hard plastic sheet, said air-permeable fibrous mat, and said layer of foam rubber together have a thickness of about 3 to 6inches.

21. The tile roof vent of claim 8 wherein said vent holes are circular, oval or rectangular having an average diameter of about 0.25 inches.

22. The tile roof vent of claim 8 wherein said vent holes are spaced from each other at about 0.5 to 1.5 inches.

23. A method of installing a tile roof vent on a roof for covering the ridge or roof to wall area of an undulating flat through high profile tile roof having an opening for receiving the tile roof vent comprising the steps of:

a) installing sinusoidal tiles in rows running across the slope of the roof from the bottom edge of the roof toward the ridge or roof to wall area, wherein said row of sinusoidal tile are being laid in alternatingly inverted and overlapped position to each other to form an undulating sequence of crests and valleys running from the bottom edge of the roof toward the ridge of the roof or to the roof to wall area, said valleys serving as gutters to lead precipitation down from the ridge or from the roof to wall area toward the bottom edge of the roof;

b) positioning two unitary panels over said opening, said panels being spaced from and projecting a mirror image of each other, wherein each of said panels comprises:

1) a hard plastic sheet having a lower portion; and an upper portion which is integral with said lower portion, said lower portion having a stiffener therein;

2) an air-permeable fibrous mat on the underside of said lower portion of the hard plastic sheet; and 3) optionally, a layer of foam rubber affixed to said fibrous mat, wherein said air-permeable fibrous mat and said layer of foam rubber conform to the undulating configuration of said tile roof; and wherein said ridge tiles covering said tile roof vent are being supported at their leading edge by said lower portions of said hard plastic sheet and a ridge board at the centers thereof;

c) affixing said lower portions of said panels to said roof by using an adhesive or fasteners; and d) affixing said upper portions of said panels to said ridge board by nails or screws.

24. The method of claim 23 wherein said lower and upper portions of said hard plastic sheet form an obtuse angle therebetween.

25. The method of claim 24 wherein said obtuse angle is larger than 90° but less than 180°.

26. The method of claim 25 wherein said angle is of from about 110° to about 140°.

27. The method of claim 23 wherein a sinusoidal shaped foam layer is attached to said sinusoidally shaped air-permeable mat on the underside thereof.

28. The method of claim 23 wherein said lower portion of said hard plastic sheet contains a plurality of stiffeners therein.

29. The method of claim 23 wherein said stiffeners arc dome-shaped.

30. The method of claim 23 wherein said hard plastic sheet contains vent holes therein.

31. The method of claim 23 wherein said hard plastic sheet contains a plurality of rows of vent holes therein.

32. The method of claim 23 wherein said undulating tile roof is of ceramic material.

33. The method of claim 23 wherein said undulating tile roof is of terra cotta.

34. The method of claim 23 wherein said undulating tile roof is of slate.

35. The method of claim 23 wherein said undulating tile roof is of metal.

36. The method of claim 35 wherein said metal is steel, aluminum or copper.

37. The method of claim 23 wherein said hard plastic sheet is made of a polymeric material selected from the group consisting of:

polyethylene;
polypropylene;
polyvinyl chloride;
nylon,
polystyrene;
polyester;
natural rubber;
acrylate-butadiene rubber;
cis-polybutadiene;
chlorobutyl rubber;
chlorinated polyethylene elastomers;
polyalkylene oxide polymers;
ethylene vinyl acetate;
fluorosilicone rubbers;
hexafluoropropylene-vinylidene fluoride-tetrafluoroethylene terpolymers;
butyl rubbers;
polyisobutene;
synthetic polyisoprene rubber;
silicone rubbers;
styrene-butadiene rubbers;
tetrafluoroethylene propylene copolymers; and
thermoplastic-copolyesters.

38. The method of claim 23 wherein said air-permeable mat comprises synthetic fibers bound together by a polymeric material selected from the group consisting of copolyester elastomers, ethylene methacrylate, ethylene vinyl acetate, ethylene vinyl alcohol, polyethylene and polypropylene.

39. The method of claim 23 wherein said foam rubber is selected from the group consisting of natural rubber, acrylate-butadiene rubber, chlorobutyl rubber, fluorosilicone rubber, butyl rubber, polyisoprene rubber and silicone rubber.

40. The method of claim 23 wherein said air-permeable mat has a thickness of about 0.5 to 3 inches.

41. The method of claim 23 wherein said foam rubber has a thickness of about 0.25 to 1.5 inches.

42. The method of claim 23 wherein said hard plastic sheet, said air-permeable fibrous mat, and said layer of foam rubber together have a thickness of about 3 to 6 inches.

43. The method of claim 31 wherein said vent holes are circular, oval or rectangular having an average diameter of about 0.25 inches.

44. The method of claim 43 wherein said vent holes are spaced from each other at about 0.5 to 1.5 inches.

* * * * *